United States Patent [19]

Inger et al.

[11] Patent Number: 5,020,735

[45] Date of Patent: Jun. 4, 1991

[54] TRANSPORT DEVICE FOR PACKAGES AND/OR TUBES THEREOF

[75] Inventors: Siegfried Inger, Krefeld; Manfred Schroeders, Moenchen-Gladbach, both of Fed. Rep. of Germany

[73] Assignee: Palitex Project Company GmbH, Fed. Rep. of Germany

[21] Appl. No.: 482,556

[22] Filed: Feb. 21, 1990

[30] Foreign Application Priority Data

Mar. 4, 1989 [DE] Fed. Rep. of Germany ..... 3906951

[51] Int. Cl.[5] ..... B65H 67/06; B65H 54/00

[52] U.S. Cl. ..... 242/1; 242/18 R; 242/18 EW; 242/47; 198/409; 198/465.4

[58] Field of Search ..... 242/1, 18 R, 47, 35.5 R, 242/35.5 A, 18 EW; 57/281, 58.49, 58.52, 58.72, 58.83; 198/409, 465.4

[56] References Cited

FOREIGN PATENT DOCUMENTS 247762 6/1966 Austria .

3802900 8/1988 Fed. Rep. of Germany .

*Primary Examiner*—Stanley N. Gilreath

*Attorney, Agent, or Firm*—Bell, Seltzer, Park & Gibson

[57] ABSTRACT

Transport and holding device for thread packages, comprising an adapter insertable into the packages and an adapter carrier, characterized in that the carrier for the package adapter is provided with a mandrel insertable into the lower end of the package adapter, and a positioning element, so as to position the adapter in a certain angular position relative to the carrier.

4 Claims, 2 Drawing Sheets

TRANSPORT DEVICE FOR PACKAGES AND/OR TUBES THEREOF

FIELD AND BACKGROUND OF THE INVENTION

The invention relates to a transport and holding device for thread packages and/or tubes thereof, comprising an adapter insertable into the tubes of the packages and a package adapter carrier, which is provided with a stop plate carrying a mandrel insertable into the lower end of the package adapter for the purpose of supporting the latter. Such a transport system is described in German Offenlegungsschrift DE-OS 38 02 900.

OBJECT AND SUMMARY OF THE INVENTION

It is the object of the present invention to design and construct such a transport and holding device so that, when a package adapter is received by a package carrier, same will be positioned relative to each other in a predetermined angular position. Such a positioning of the adapter with the packages or their tubes placed thereon is desired, when any maintenance or preparation work needs to be done on the package adapter and/or the packages and/or the package tubes by means of mechanical devices, which are transported, for example, automatically on the package adapters inserted on the adapter carriers.

To accomplish this object, a thread transport and holding device is provided for at least one hollow thread package and which comprises a hollow elongate package adapter insertable into the hollow thread package for holding the thread package thereon, and a package adapter carrier having a mandrel insertable into a lower end of the thread package adapter for supporting the package adapter and the thread package carried thereby. Positioning means are provided on the mandrel of the package adapter carrier and means are provided on the package adapter which cooperate with the positioning means for positioning the package adapter and the thread package carried thereby in a certain angular position relative to the position of the package adapter carrier so that work can be performed on the thread package or the thread package adapter is a desired position.

Preferably, the positioning means on the mandrel of the package adapter carrier is in the form of a pin on the mandrel which extends radially outwardly therefrom and the cooperating means on the package adapter comprises guide surfaces on the inside thereof extending obliquely and/or spirally for cooperating with and guiding the positioning pin on the mandrel and a downwardly open groove communicating with the guide surfaces for receiving and holding the positioning pin. Preferably, the package adapter further includes a first opening in the outer surface of the package adapter in the upper end region thereof, an interior channel extending from the first opening circumferentially through the package adapter, and a second opening in the outer surface of the package adapter communicating with the other end of the channel, so that a thread end from the thread package carried by the package adapter may be placed at the first opening and a suction device may be placed at the second opening for sucking and conveying the thread through the channel and out of the second opening for convenient positioning of the thread end for subsequent use. The package adapter also preferably includes means at its upper end for receiving and holding attachments including a suspension holder.

BRIEF DESCRIPTION OF THE DRAWINGS

The invention will be described hereinbelow in greater detail with reference to the drawing, in which.

DETAILED DESCRIPTION OF THE PREFERRED EMBODIMENT OF THE INVENTION

Figure 2:
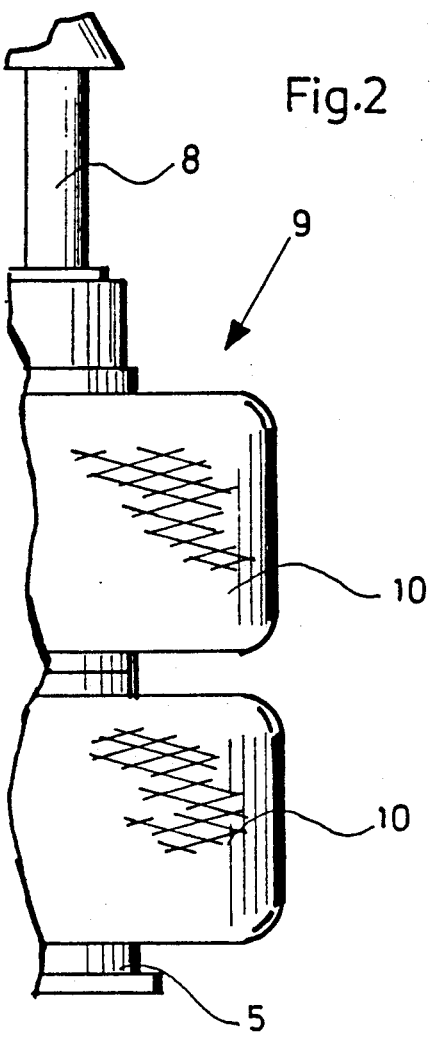
FIG. 2 is a view of a package adapter and a package unit comprising two packages.
Figure 1:
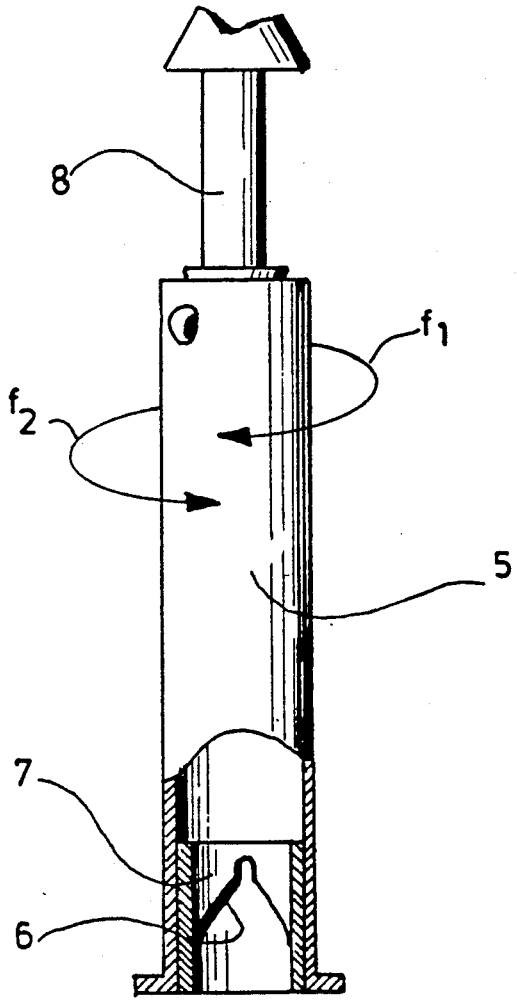
FIG. 1 is a schematic, in part sectional view of a package adapter with an associated adapter carrier.
Figure 1:
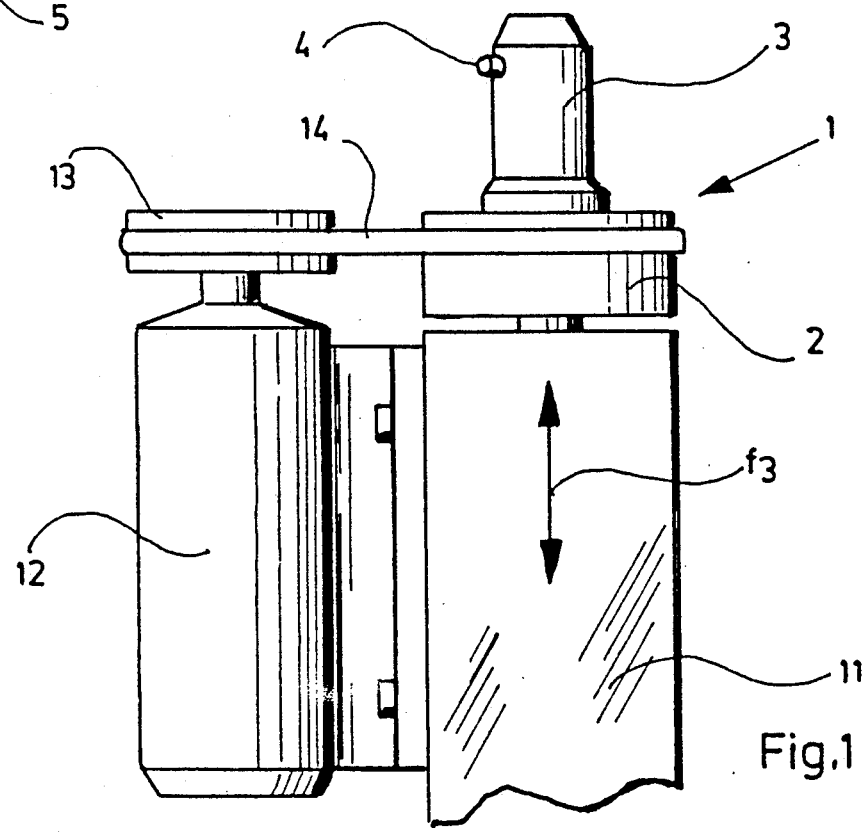
Figure 3:
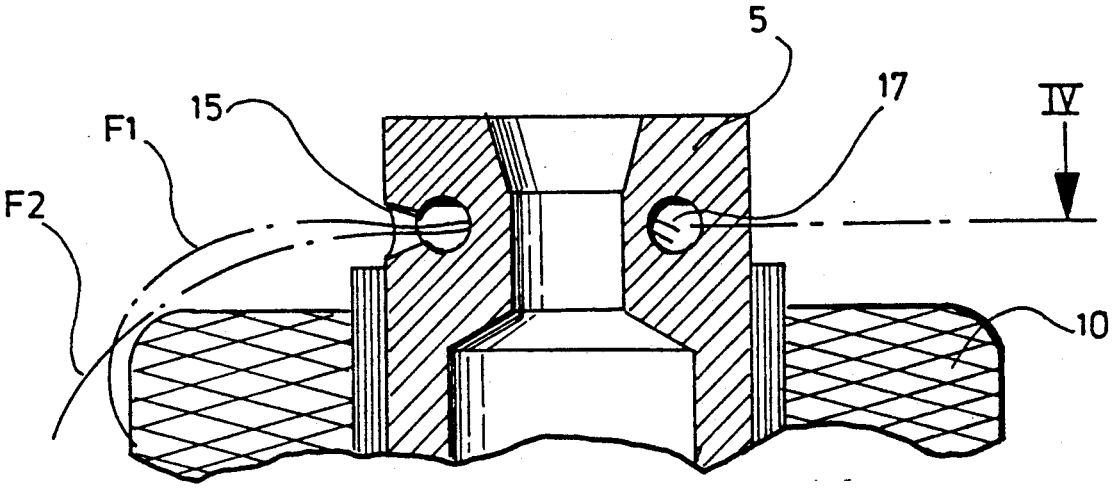
FIG. 3 is an enlarged, longitudinal sectional view of the upper end of the package adapter.
Figure 4:
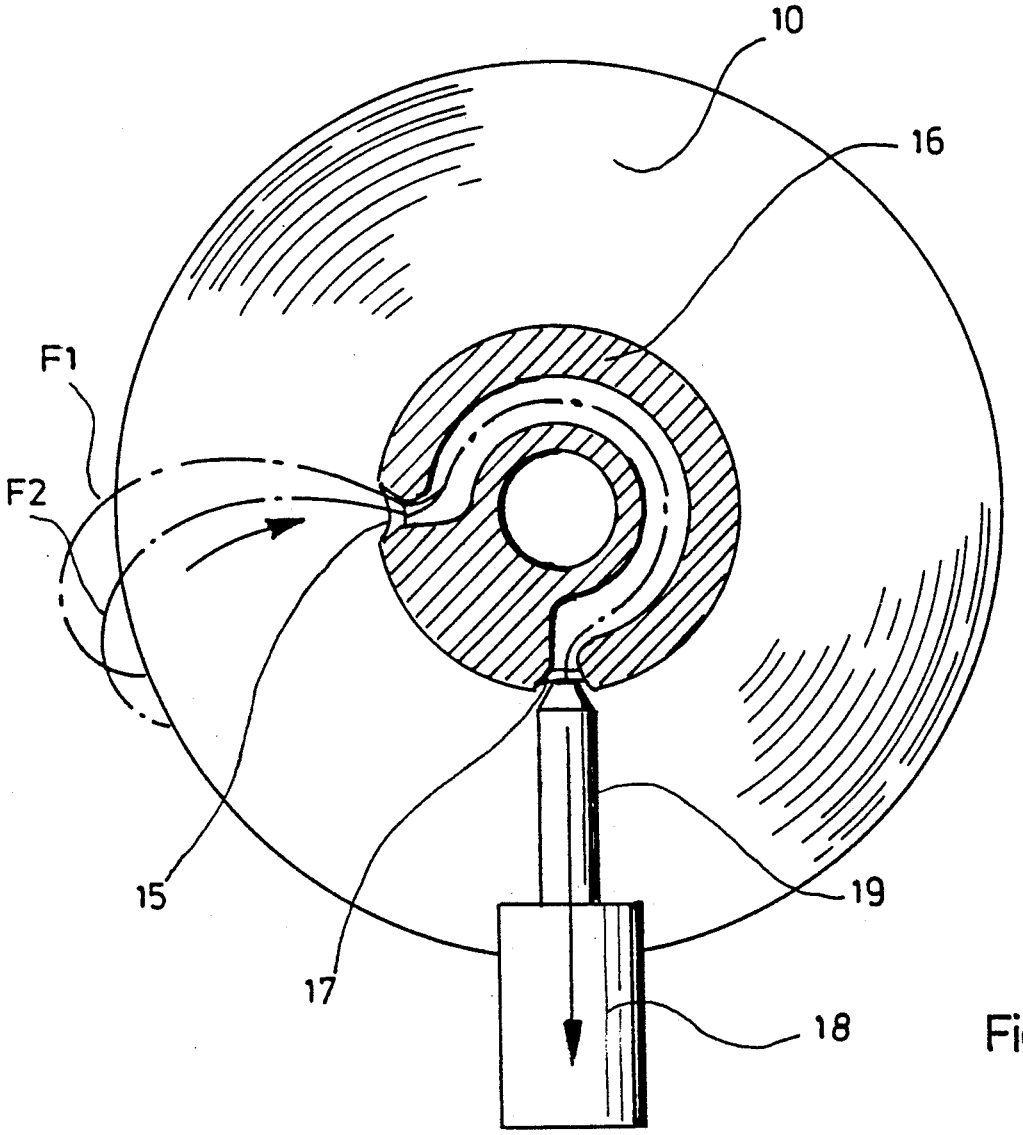
FIG. 4 is a sectional view along the line IV of FIG. 3.

Illustrated in FIG. 1 is a package adapter 5, which is engaged with, for example, a standard-type suspension holder 8 for thread packages. The package adapter 5 serves to form packages units 9, which comprise the adapter 5 and at least one fully wound package 10. The package adapter is suited for use both as a transport adapter and as a holding adapter in the area of further processing machines.

At its lower end on its inner side, the package adapter 5 is provided with obliquely and/or spirally extending guide surfaces 6 and a downwardly open groove 7. Attached to the lower end of the package adapter 5 is a flange projecting radially outwardly for receiving the packages or the cores thereon.

A package adapter corner 1 comprises a stop plate 2 with a mandrel 3 insertable into the lower end of the package adapter 5, which mandrel is provided with a positioning element in the form of a preferably radially directed pin 4.

When inserting a mandrel 3 into the package adapter 5, the latter is rotated in direction of arrows f1 or f2 by the interaction of the guide surfaces 6 and positioning pin 4, until the latter engages in groove 7. As a result, a certain relative position between the package adapter 5 and the mandrel 3 or the adapter carrier 1 is obtained, when the mandrel 3 moves into the package adapter 5.

As can be noted from FIG. 1, the package adapter carrier 1 is attached to a lifting element 11 adapted to move upward and downward in direction of the double arrow f3. In order to move the package adapter carrier 1, depending on the circumstances, to a certain rotated position, a drive unit 12 comprising a drive pulley 13 and a drive belt 14 is mounted on the lifting element so as to rotatingly drive the package adapter carrier 1.

Arranged on the upper end of the package adapter 5 is a first opening 15, which is followed by a yarn guide channel 16 extending in circumferential direction over a predetermined angle and leading to a second opening 17. The opening 17 serves to receive a suction nozzle 18. When this suction nozzle is biased by suction air, the yarn ends, which have been moved to the first opening 15, are sucked by the nozzle 18 through the yarn guide channel into the suction channel 19. This arrangement makes it possible, already as a preparation after fully wound packages 10 have been creeled on the adapter, to place and hold the yarns F1 and/or F2 advancing from these packages in defined positions, thereby facilitating subsequent, in particular automated operations, such as in particular the locating and grasping of the yarns. After the suction air operative in the region of the nozzle 18 is cut off, the latter is again removed from the package adapter 5, so that the yarn ends will hang out of the outlet opening 17, preferably at defined, uniform lengths, if a cutting device not shown is associated with the suction nozzle.

Preferably, the upper, central opening of the package adapter 5 is designed and constructed such that it is suited for receiving and holding attachments, such as, for example, yarn finish tanks, shafts for unwinding means, or hubs of twisting flyers and the like.

It is further preferred to equip the package adapter with suitable information carriers, which contain data legible by means of suitable reading devices, such as, for example, the type packages creeled on the adapter, the destination of the package adapter or package transport adapter, and the like.

What is claimed is:

1. In a transport and holding device for at least one hollow thread package comprising a hollow elongate package adapter insertable into the hollow thread package for holding the package thereon; and a package adapter carrier having a mandrel insertable into a lower end of said package adapter for supporting said package adapter and the thread package carried thereby; the improvement of positioning means on said mandrel of said package adapter carrier, and means on said package adapter cooperating with said positioning means for position said package adapter and thread package carried thereby in a certain angular position relative to the position of said package adapter carrier so that work can be performed on the thread package or said thread package adapter in a desired position.

2. In a transport and holding device, according to claim 1, in which said positioning means on said package adapter carrier comprises a pin on said mandrel extending radially outwardly therefrom, and in which said cooperating means on said package adapter comprises guide surfaces on the inside thereof extending obliquely and/or spirally for cooperating with and guiding said positioning pin on said mandrel and a downwardly open groove communicating with said guide surfaces for receiving and holding said positioning pin.

3. In a transport and holding device, according to claim 1, wherein said package adapter further includes a first opening in the outer surface of said package adapter in the upper end region thereof, an interior channel extending from said first opening circumferentially through said package adapter, and a second opening in the outer surface of said package adapter communicating with the other end of said channel, so that a thread end from the thread package carried by said package adapter may be placed at said first opening and a suction device may be placed at said second opening for sucking and conveying the thread end through the channel and out of the second opening for convenient positioning of the thread end for subsequent use.

4. In a transport and holding device, according to claim 1, in which said package adapter further includes means on its upper end for receiving and holding attachments including a suspension holder.

* * * * *

UNITED STATES PATENT AND TRADEMARK OFFICE

CERTIFICATE OF CORRECTION

PATENT NO. : 5,020,735

DATED : June 4, 1991

INVENTOR(S) : Siegfried Inger and Manfred Schroeders

It is certified that error appears in the above-identified patent and that said Letters Patent is hereby corrected as shown below:

On the title page, in the title, item [54] lines 1 and 2, and in col. 1, lines 1 and 2, delete in its entirety and substitute the following:

-- TRANSPORT AND HOLDING DEVICE FOR THREAD PACKAGES --.

Column 2, line 32, "corner" should be -- carrier --.

Column 2, line 34, after "mandrel" insert -- 3 --.

Signed and Sealed this

Twenty-second Day of September, 1992

*Attest:*

DOUGLAS B. COMER

*Attesting Officer*

*Acting Commissioner of Patents and Trademarks*